US005516261A

United States Patent [19]

Zelder

[11] Patent Number: 5,516,261

[45] Date of Patent: May 14, 1996

[54] UNCHOKABLE CENTRIFUGAL PUMP

[75] Inventor: Manfred Zelder, Bonn, Germany

[73] Assignee: Wilo GmbH, Dortmund, Germany

[21] Appl. No.: 258,241

[22] Filed: Jun. 10, 1994

[30] Foreign Application Priority Data

Nov. 15, 1993 [DE] Germany ..... 4338931.7

[51] Int. Cl.[6] ..... F01D 25/00

[52] U.S. Cl. ..... 415/121.1

[58] Field of Search ..... 415/121.1, 206

[56] References Cited

U.S. PATENT DOCUMENTS

| | | | |
|---|---|---|---|
| 1,718,396 | 6/1929 | Wheeler . | |
| 2,245,035 | 6/1941 | Hartman . | |
| 2,265,758 | 12/1941 | Klosson . | |
| 3,096,718 | 7/1963 | Anderson | 415/121.1 |
| 3,340,812 | 9/1967 | Schlesiger | 415/121.1 |
| 3,447,475 | 6/1969 | Blum | 415/121.1 |

FOREIGN PATENT DOCUMENTS

| | | | |
|---|---|---|---|
| 211773 | 11/1960 | Austria | 415/121.1 |
| 0395604 | 10/1990 | European Pat. Off. . | |
| 240859 | 11/1911 | Germany | 415/121.1 |
| 819346 | 10/1951 | Germany | 415/121.1 |
| 798359 | 1/1981 | U.S.S.R. | 415/121.1 |

*Primary Examiner*—John T. Kwon
*Attorney, Agent, or Firm*—Herbert Dubno; Yuri Katesov

[57] ABSTRACT

A centrifugal pump having a single-blade rotor whose central suction mouth, remote from the driving shaft, is in alignment with the inlet opening, the inlet opening forming an annular collar which so projects into the inside of the rotor that the inner end of the rotor blade forms a narrow gap with the outer surface of the collar.

16 Claims, 4 Drawing Sheets

UNCHOKABLE CENTRIFUGAL PUMP

FIELD OF THE INVENTION

The present invention relates to a centrifugal pump having a single-blade rotor whose central suction mouth, remote from the driving shaft, is in alignment with the inlet opening of the pump chamber.

BACKGROUND OF THE INVENTION

Non-chokable pumps are often used for waste waters charged with solids. These non-chokable pumps have maximum efficiencies of approximately 50%, but in practical application the efficiency is below 40%. These low efficiencies result in an overdimensioning of the driving motor. Since in submersible motor-driven pumps the motor represents approximately 80% of the value of a pump, there is an increase in the investment costs required to deliver a predetermined quantity of liquid to a given height.

Non-chokable pumps also have the peculiarity that solids accumulate at the center of the rotor and reduce the unobstructed flow passage, so that the pump output is throttled. The pump itself does not become clogged, since the end face of the rotor is well away from the wall of the pump casing.

Rotors having an improved efficiency are single-channel rotors having only one blade. These rotors attain efficiencies of over 70% if they are spatially curved. Because of the spatial curvature, the rotors cannot be turned down to reach other operating points. A separate rotor is therefore required for each characteristic line and also its own model in the foundry. Cylindrical rotors can be turned down and have a slightly lower efficiency than the spatially curved ones.

OBJECT OF THE INVENTION

It is therefore an object of the present invention to provide an improved centrifugal pump which is of simple construction and manufacture, and to a high degree unchokable.

SUMMARY OF THE INVENTION

This object is achieved according to the invention by providing the inlet opening so that it forms an annular collar which so projects into the inside of the rotor that the inner end of the rotor blade forms a narrow gap with the outer surface of the collar.

Such a pump does not become choked, even by very troublesome solids in the medium being delivered such as, for example, plastics, bags and pantyhose. The pump is therefore particularly efficient for waste waters of different kinds. Moreover, the cylindrical rotor of the pump according to the invention can be turned down.

Particularly advantageously mounted in the pump chamber side wall having the inlet is an end plate forming the collar directly or via an insert.

Preferably according to the invention the insert forming the collar lies bush-fashion or sleeve-like at least in that zone of the inlet which is adjacent the rotor.

Also preferably according to the invention the end of the chamber side wall adjacent the rotor forms, especially via an end plate, a spiral groove which extends around the inlet and through which solids penetrating between the rotor and the chamber side wall can be moved outwards. Solids forcing themselves in between the lower edge of the rotor and the chamber side wall are entrained by the spiral and move radially outwards, so that the rotor spontaneously frees itself from jammed solids.

It is of the greatest advantage if on the outside of the collar the end plate is adjoined by a coaxial toothed rim whose teeth are directed substantially radially. The effect of the radial teeth is that the solid material does not endlessly corotate with the rotor, but is held back, so that the outwardly rotating spiral can develop its full action. In this way solids which have become looped around the front edge of the rotor are also held back via the teeth and subjected to the action of the spiral. Lastly, the teeth can exert a comminuting action on certain solids.

Preferably according to the invention that end face of the inner end of the rotor blade which is adjacent the bottom plate extends around above the toothed rim at a small distance. The spiral groove should adjoin the outside of the toothed rim.

Also preferably according to the invention the width of the teeth and therefore of the toothed rim is substantially equal to the width of the end face of the inner end of the rotor blade, and the rotor blade end has a radius, so that the solids can be drawn in much more simply.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
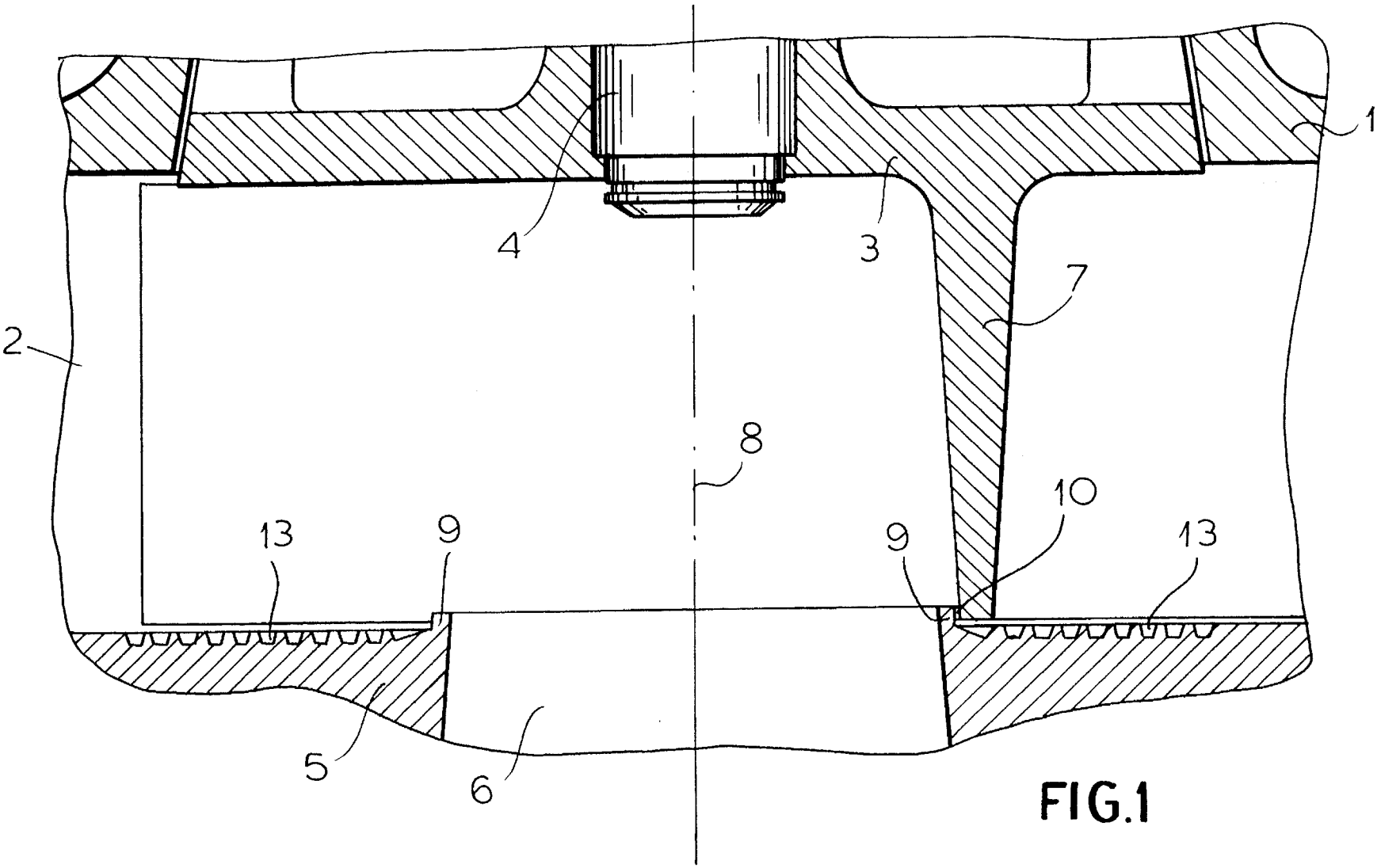
FIG. 1 is an axial section through a detail of a first embodiment.

A centrifugal pump has a pump casing 1 forming a pump chamber 2 in which a rotor 3 is mounted. The rotor 3 is driven by an electric motor (not shown) via a shaft 4.

On the side remote from the shaft 4 and the electric motor the chamber 2 is closed by a pump chamber side wall 5 which lies at a right angle to the axis of the shaft 4 and forms a pump inlet 6 which lies coaxially with the shaft 4 and is therefore in alignment with the suction mouth of the rotor 3.

The rotor 3, which is cylindrical and can therefore be turned down, has only one single curved blade 7 whose inner end 7*a*–i.e., the end closer to the rotor axis 8–rotates very close to the edge of the inlet 6. The inner edge of the inlet 6 forms an annular collar 9 which extends a few millimeters into the rotor 3 and therefore into the suction mouth of the rotor 3, so that the collar 9 projects beyond the inner end 7*a* by a few millimeters. Preferably the collar 9 projects beyond the inner end 7*a* by 2 to 5, preferably 2.5 to 3 millimeters.

Left between the outside of the collar 9 and the inside wall of the inner end 7*a* of the rotor blade is a gap 10 of only approximately a fraction of a millimeter, the radial width S of the gap increasing with increasing output.

Figure 2:
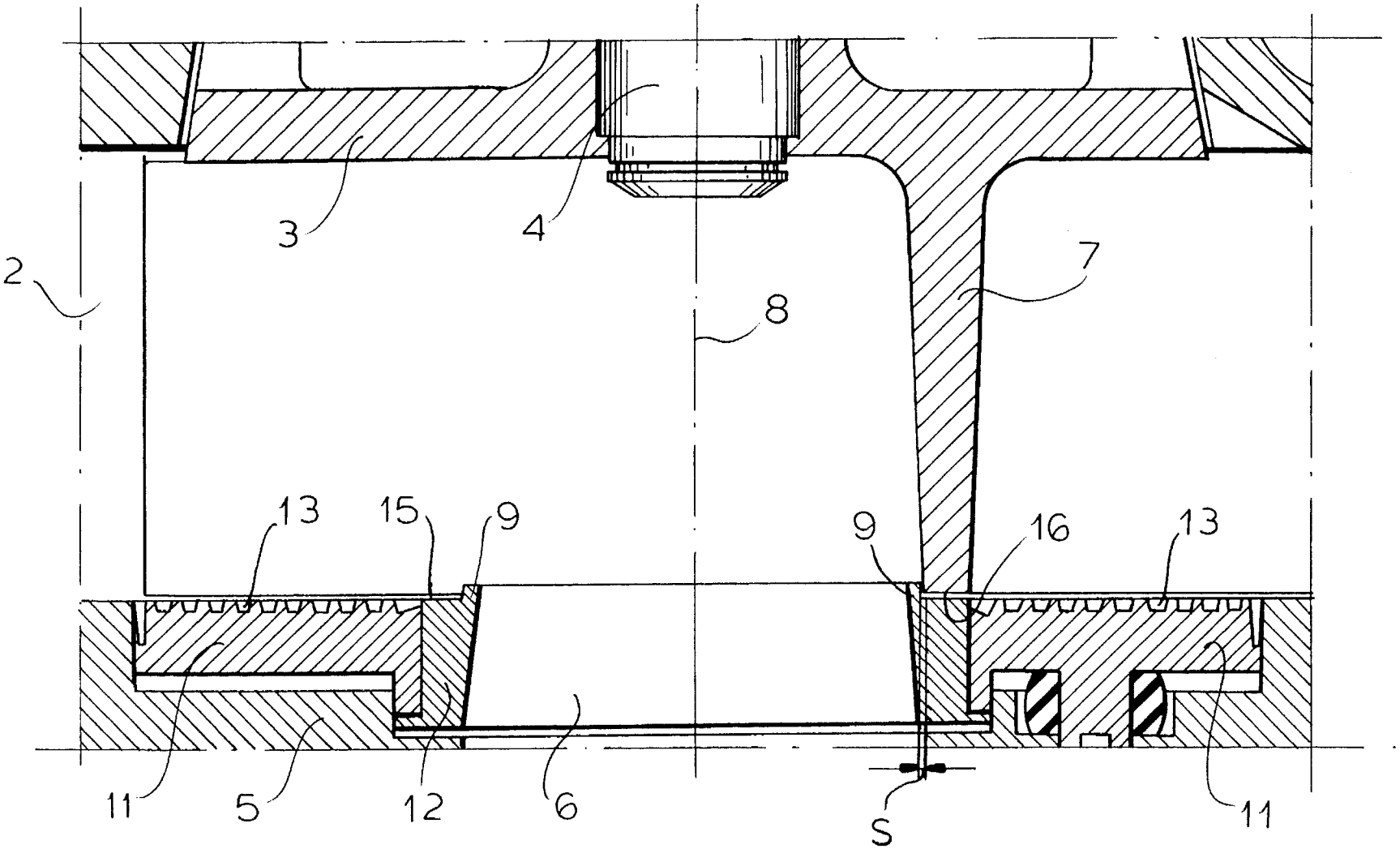
FIG. 2 is an axial section through a detail of a second embodiment.

The collar 9 can be directly formed by the pump chamber side wall 5 (FIG. 1) in one piece therewith or by an end plate 11 or an insert 12 attached to the end plate 11 (FIG. 2). The insert 12 can line the inlet 6 as a bush or sleeve.

Figure 4:
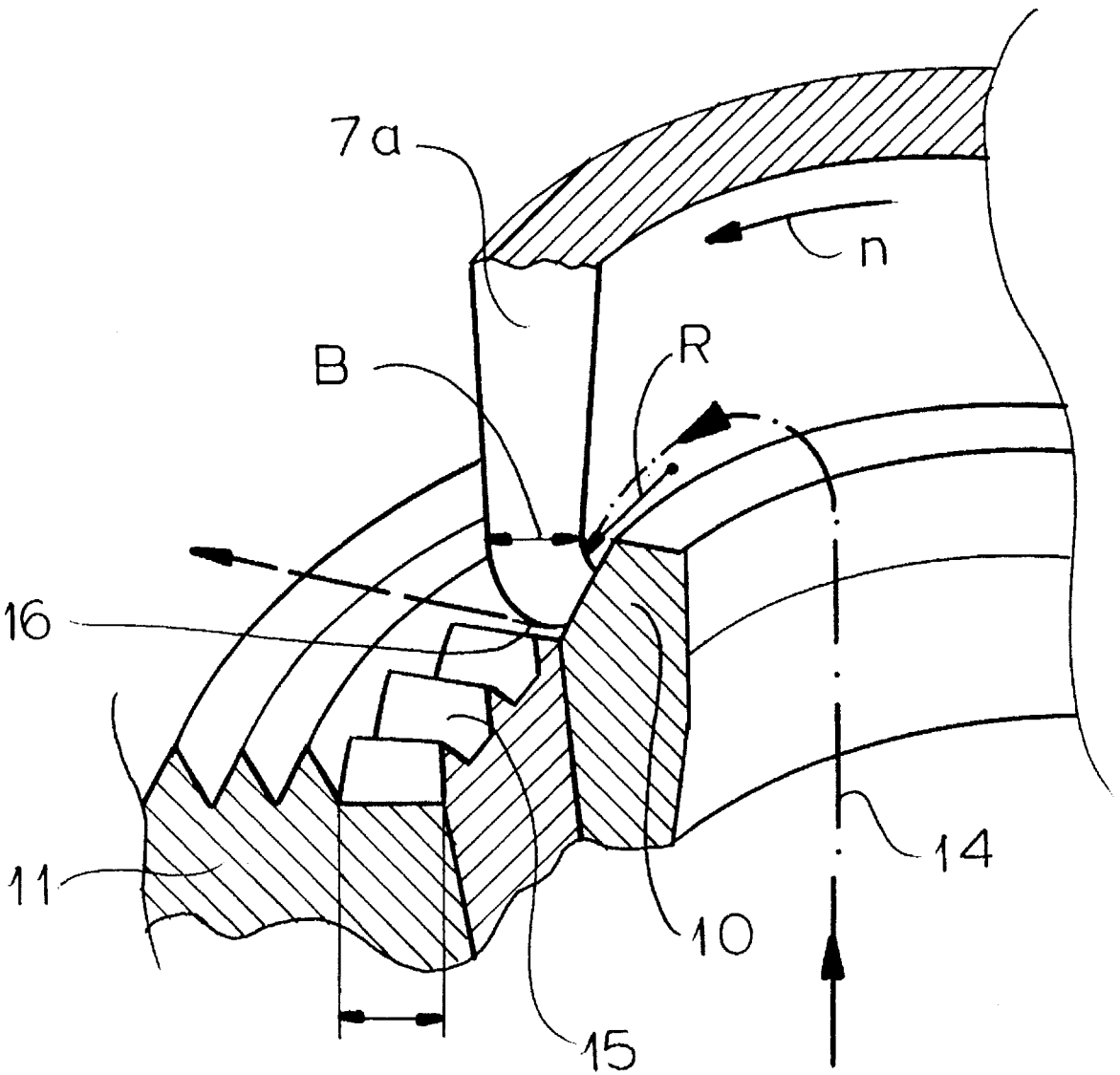
FIG. 4 is a detail perspective view of the collar, toothed rim, spiral and inner end of the rotor blade.

As FIG. 1 shows, on the inside of the pump chamber side wall 5 the insert 6 is surrounded by a spiral groove 13 having in relation to the circulating liquid a spiral direction A such that solids penetrating between the rotor blade and the chamber side wall are driven radially outwards, as shown by the dot-dash line direction of flow 14 with arrows, shown in FIG. 4.

Figure 3:
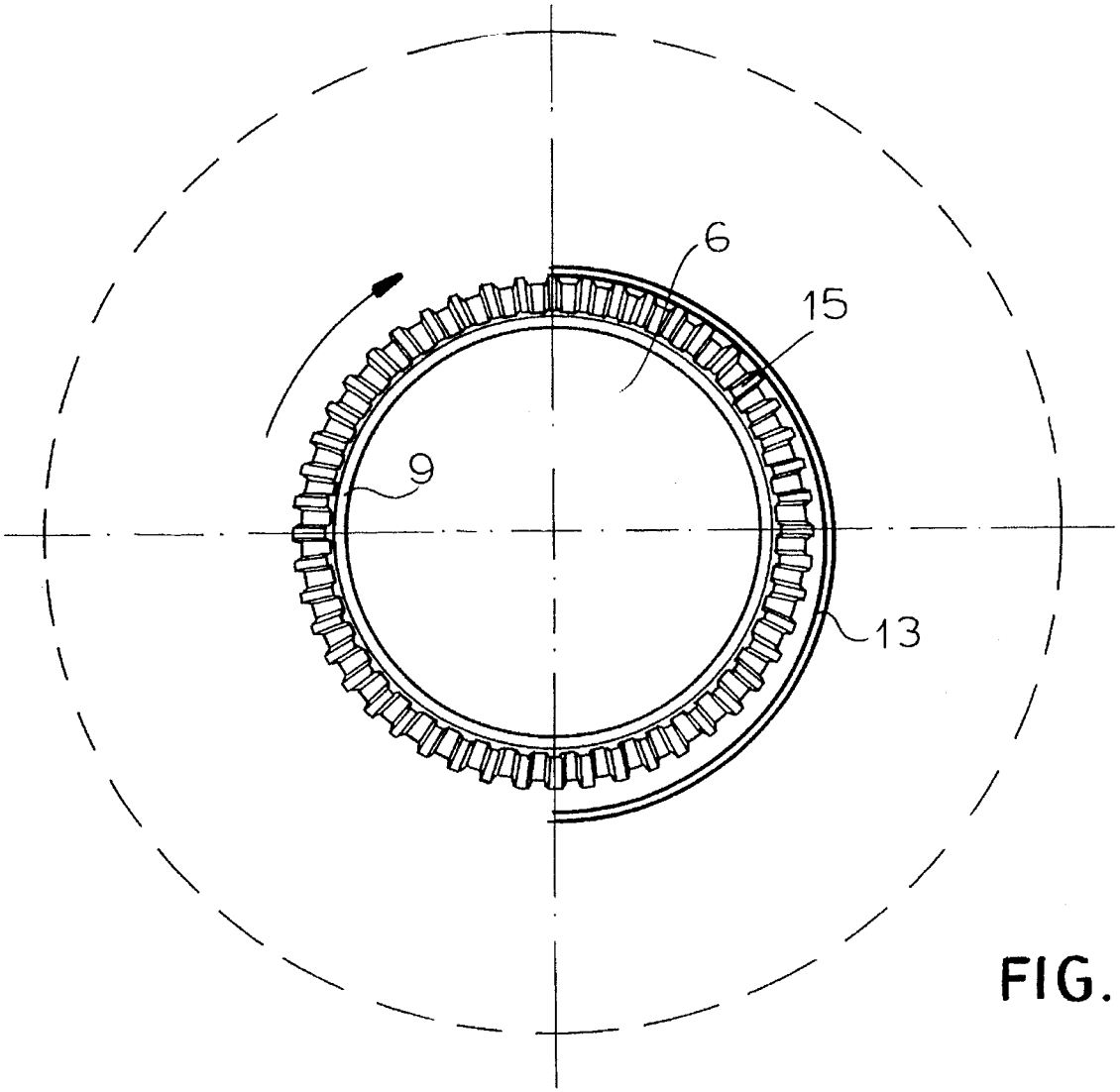
FIG. 3 is a view showing the pump chamber side wall with toothed rim and a short inner zone of the spiral.

In the embodiment illustrated in FIGS. 2 to 4, disposed between the collar 9 and the spiral groove 13 is a coaxial toothed rim 15 over which end face 16 of the inner end of the rotor blade is disposed at a small distance, the width b of the toothed rim being substantially equal to the width B of the end face 16. The teeth of the toothed rim 15 lies substantially radially in relation to the rotor axis 8 –i.e., the straight tooth flank lines of the teeth are disposed substantially radially.

Particularly advantageously the lower front end of the rotor blade front side has a radius via which the fibrous substances are drawn in by the rotor blade and forced to move outwards, due to the design of the end plate. The transition from the inner end 7*a* to the end face 16 is therefore rounded off, the rounding having the radius R.

I claim:

1. A centrifugal pump comprising:

a pump housing surrounding an axis and formed with a pump chamber having a side wall defining an inlet opening centered on said axis;

an end plate .received in a side wall of said housing;

a driving shaft axially aligned with said inlet opening;

a single-blade rotor having an inner end Juxtaposed with said end plate and a central suction mouth remote from the driving shaft in alignment with the inlet opening of the pump chamber; and an annular collar surrounding said inlet opening and so projecting into the inside of the rotor that an inner end of a rotor blade of said rotor forms a narrow gap with an outer surface of the collar, said outer surface being provided with a coaxial toothed rim having teeth directed substantially radially and disposed adjacent said end plate and spaced from said inner end of the rotor at a small distance, a width of the toothed rim (b) being substantially equal to a width (B) of the end face of the inner end of the rotor blade.

2. The centrifugal pump defined in claim 1, further comprising: an end plate mounted in a side wall of said housing formed with the inlet opening, said end plate being formed with the collar.

3. The centrifugal pump defined in claim 1 wherein said end plate is formed directly with the collar.

4. The centrifugal pump defined in claim 2 wherein said end plate is provided with an insert formed with said collar.

5. The centrifugal pump defined in claim 4 wherein the insert forming the collar is a sleeve disposed at least at a zone of the inlet opening which is adjacent the rotor.

6. The centrifugal pump defined in claim 1 wherein said housing has a chamber side wall adjacent the rotor formed with a spiral groove which extends around the inlet opening and via which solids penetrating between the rotor and the chamber side wall are displaceable outwards.

7. The centrifugal pump defined in claim 6 wherein said spiral groove is formed on an end plate mounted in said side wall.

8. The centrifugal pump defined in claim 1 wherein a spiral groove is formed in said end plate adjoining an outside of the toothed rim.

9. The centrifugal pump defined in claim 1 wherein an end face lower end of a front side of the rotor blade has a rounded portion having a radius (R) through which fibrous materials are drawn in.

10. The centrifugal pump defined in claim 1 wherein an end face lower end of a front side of the rotor blade has a rounded portion having a radius (R) through which fibrous materials are drawn in.

11. A centrifugal pump comprising:

a pump housing surrounding an axis and formed with a pump chamber having an inlet opening centered on said axis;

a driving shaft axially aligned with said inlet opening;

a single-blade rotor having a central suction mouth remote from the driving shaft in alignment with the inlet opening of the pump chamber; and an annular collar surrounding said inlet opening and so projecting into the inside of the rotor that an inner end of a rotor blade of said rotor forms a narrow gap with an outer surface of the collar, said outer surface being provided with a coaxial toothed rim having teeth directed substantially radially.

12. The centrifugal pump defined in claim 11 wherein said rim is disposed adjacent an end plate received in a side wall of said housing formed with said inlet opening.

13. The centrifugal pump defined in claim 12 wherein an end face of an inner end of the rotor blade which is adjacent the end plate extends around above the toothed rim at a small distance therefrom.

14. The centrifugal pump defined in claim 12 wherein a spiral groove is formed in said end plate adjoining an outside of the toothed rim.

15. The centrifugal pump defined in claim 12 wherein a width (b) of the teeth and of the toothed rim is substantially equal to a width (B) of the end face of the inner end of the rotor blade.

16. The centrifugal pump defined in claim 13 wherein an end face lower end of a front side of the rotor blade has a rounded portion having a radius (R) through which fibrous materials are drawn in.

* * * * *